US005735733A

United States Patent [19]

Lombardi

[11] Patent Number: 5,735,733

[45] Date of Patent: Apr. 7, 1998

[54] DRUM SANDING APPARATUS

[75] Inventor: Donald G. Lombardi, Thousand Oaks, Calif.

[73] Assignee: Drum Workshop, Inc., Oxnard, Calif.

[21] Appl. No.: 835,003

[22] Filed: Apr. 7, 1997

[51] Int. Cl.[6] ..... B24B 5/00

[52] U.S. Cl. ..... 451/307; 451/49; 451/51; 451/61

[58] Field of Search ..... 451/307, 51, 49, 451/61, 397, 398, 246, 332, 56

[56] References Cited

U.S. PATENT DOCUMENTS

| | | | |
|---|---|---|---|
| 3,537,831 | 11/1970 | Foster | 451/307 |
| 5,433,042 | 7/1995 | Billieres et al. | 451/307 |
| 5,595,524 | 1/1997 | Gundy | 451/51 |

FOREIGN PATENT DOCUMENTS

| | | | |
|---|---|---|---|
| 1214392 | 4/1960 | France | 451/307 |
| 403251353 | 11/1991 | Japan | 451/51 |

*Primary Examiner*—Robert A. Rose
*Assistant Examiner*—George Nguyen
*Attorney, Agent, or Firm*—William W. Haefliger

[57] ABSTRACT

An apparatus to sand the outer surface of a cylindrical drum shell, the shell defining a first longitudinal axis, and comprising a frame; first structure on the frame to position and rotate the drum about the axis; first structure on the frame, including a belt, for engaging and treating the drum surface during drum rotation; and second structure on the frame to effect pressural engagement of the rotating drum surface with the belt.

14 Claims, 6 Drawing Sheets

91
92
93
86
88
90
89

17
73b
80
8
22
23
30
24
20
83
82
26
14b
84
14
5
91
85
86
87
92
14a
51
13
89
72
73b
18
28
74b

DRUM SANDING APPARATUS

BACKGROUND OF THE INVENTION

This invention relates generally to manufacture of drum shells, and more particularly to sanding the outer surfaces of different size shells, i.e., shells having different diameters or lengths.

There is need to reduce the cost of drum fabrication, and in particular, the cost of finishing the outer sides of wooden or plastic drum shells. Such finishing normally includes sanding the shell surface in order to receive lacquer or varnish or other fluid application, to provide an attractive surface. However, drum shells are of different sizes, so that automated sanding is not considered possible or practical. Accordingly, there is need to provide apparatus and method enabling efficient sanding; also, there is need for an automated, improved, practical apparatus which easily accomplishes sanding of drum shells of different sizes, as in the highly advantageous manner disclosed herein.

SUMMARY OF THE INVENTION

It is a major object of the invention to provide improved apparatus and method meeting the above needs. Basically, the apparatus of the invention is usable to sand the outer surface of a cylindrical drum shell which defines a longitudinal axis, and comprises:

a) a frame, b) first means on the frame to position and rotate the drum about the axis, c) first structure on the frame, including a sanding belt, for engaging the drum surface during drum rotation, d) and second means on the frame to effect pressural engagement of the rotating drum surface with the sanding belt.

It is another object to provide a sanding belt that extends in a loop and travels endwise or loopwise, such first structure including third means to drive the belt loopwise to tangentially travel in sanding engagement with the rotating drum surface.

A further object includes the provision of the second means to include an actuator including a rotatable pusher engaging the drum, and third means to control operation of the actuator to control pusher positioning in a direction toward the sanding belt. Typically, the rotatable pusher engages an inner cylindrical surface defined by the drum shell.

Yet another object includes provision of drum shell positioning idler means engaging the shell, and positioned by the third means.

An additional object includes provision of carrier means on the frame for relatively moving the drum shell and sanding belt in a direction parallel to the drum axis. That carrier means typically includes a movable carrier carrying the second means, and a track supporting the movable carrier, the track extending in the direction of the axis.

A yet further object includes provision of a drive operatively connected to the carrier to adjustably drive the carrier along the track, thereby to transport the drum shell crosswise of the belt. In this regard, control means is typically provided to adjust the extent of travel of the carrier along the track; and it may advantageously include an adjustable linkage coupling the drive to the frame.

As will be seen, the invention enables the belt to have width substantially less than the maximum width of the drum shell to be sanded, so that the narrowed belt may be used to sand drum shells of a wide range of lengths.

These and other objects and advantages of the invention, as well as the details of an illustrative embodiment, will be more fully understood from the following specification and drawings, in which:

DRAWING DESCRIPTION

DETAILED DESCRIPTION

Figure 1:
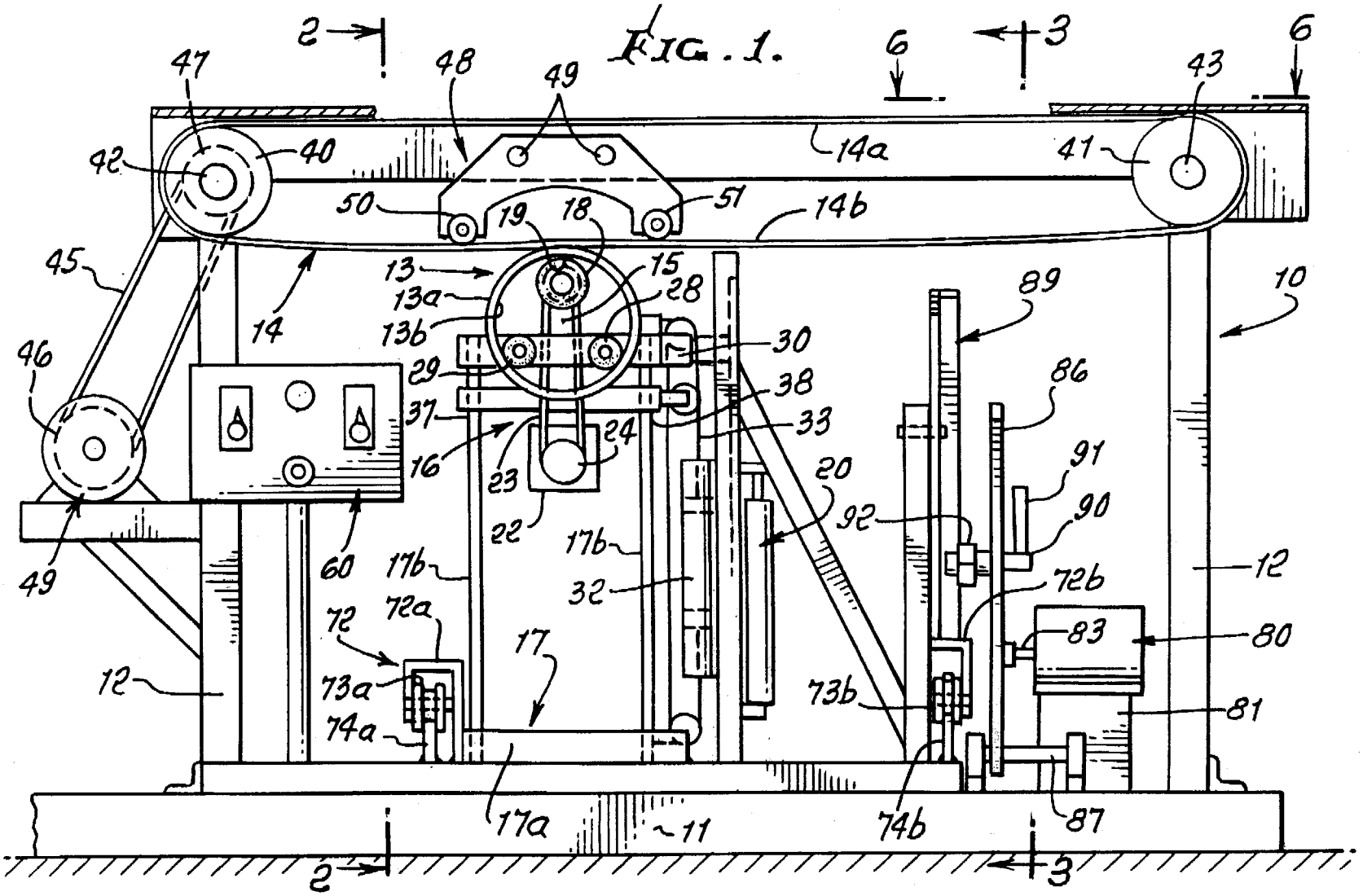
FIG. 1 is an elevation showing preferred apparatus incorporating the invention.

In the drawings, a frame 10 includes a base 11 and uprights 12 rigidly supported by the base. A drum to be sanded is positioned at 13 and has an outer surface 13*a* to be engaged by a sanding belt 14, and an inner surface 13*b*. Those surfaces are concentric about a drum axis 15 which extends longitudinally.

First means is provided on the frame to rotate the drum about axis 15. Such first means is generally indicated at 16, and includes a sub-frame 17 having a sub-base 17*a* and uprights 17*b* extending upwardly from the sub-base. The sub-frame is indirectly carried by the frame 10.

Figure 2:
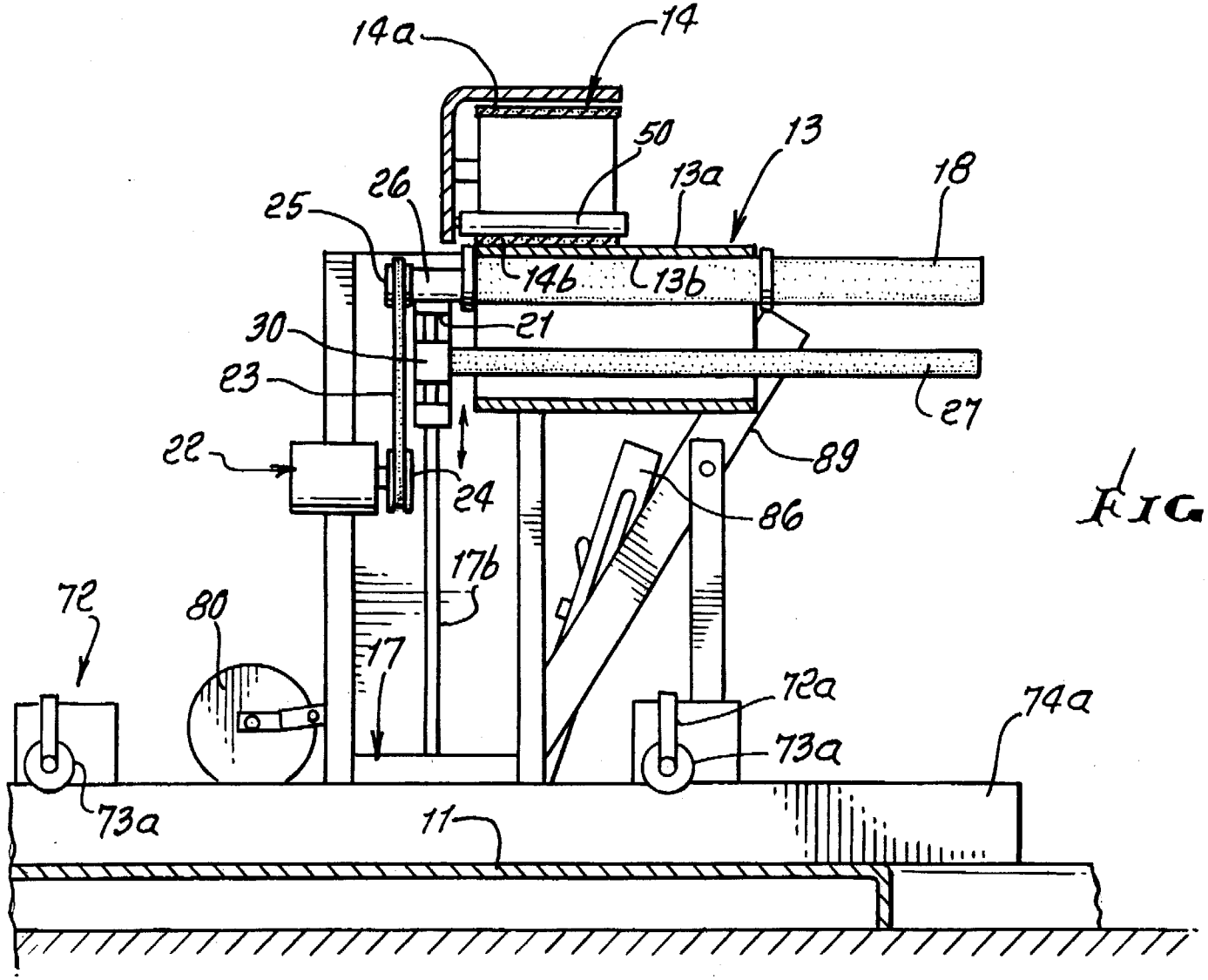
FIG. 2 is a section taken on lines 2—2 of FIG. 1.
Figures 3, 5:
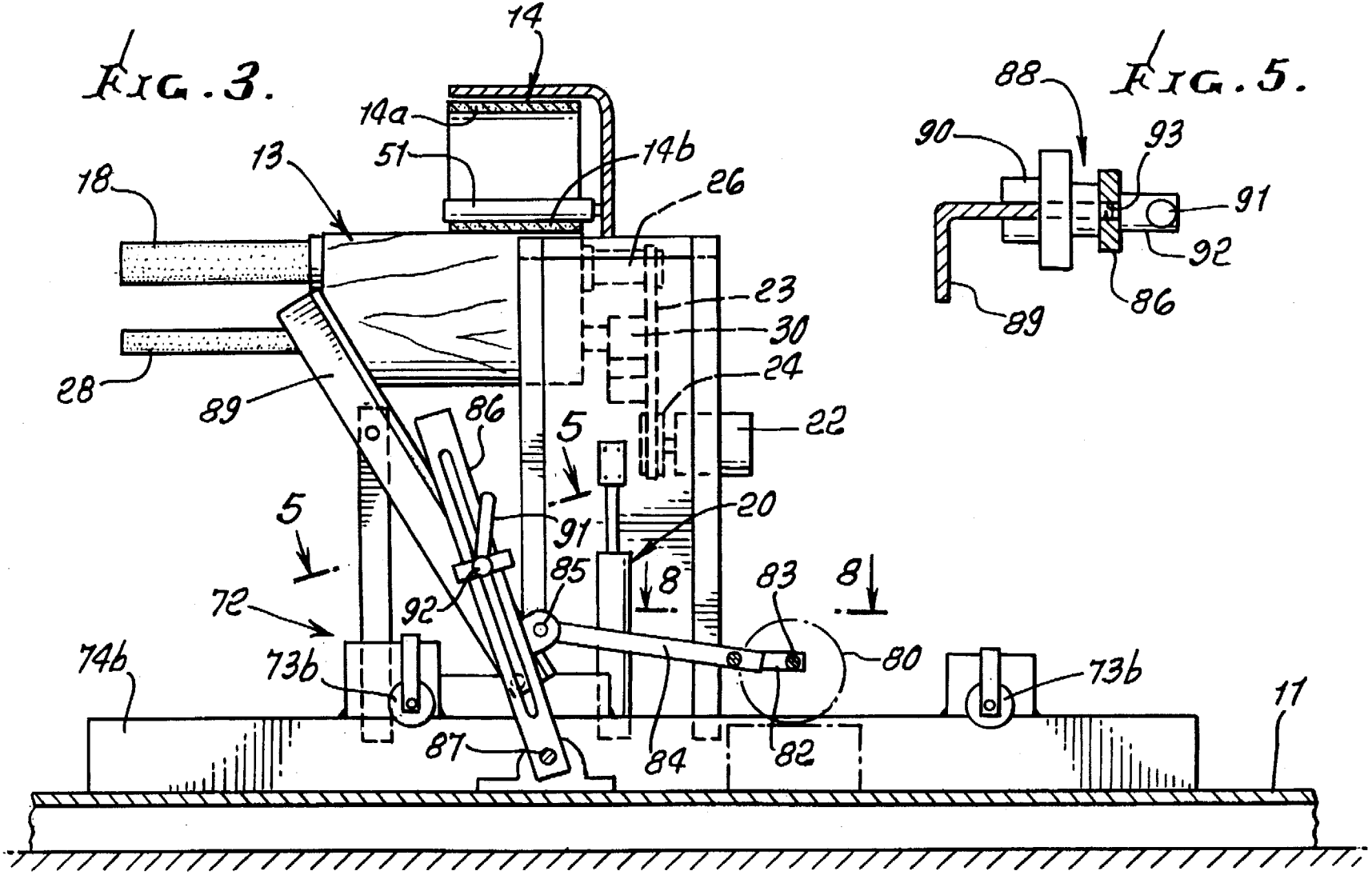
FIG. 3 is a section taken on lines 3—3 of FIG. 1.
FIG. 5 is a section taken on lines 5—5 of FIG. 3.
Figure 4:
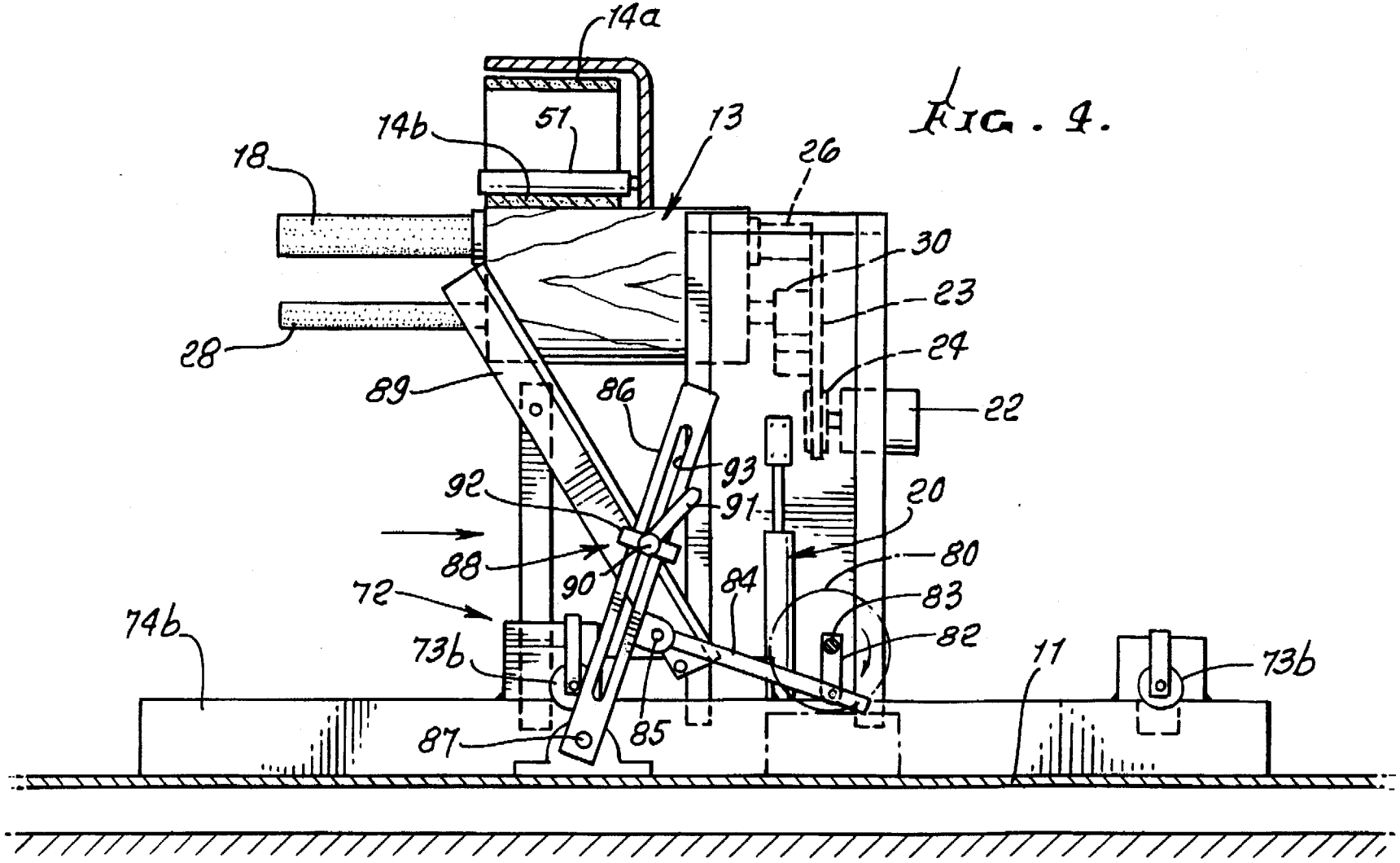
FIG. 4 is a section like that of FIG. 3 but showing the drum in a position axially spaced from its position seen in FIG. 3.

The drum is positioned by a rotatable pusher in the form of an annulus 18 tangentially engaging the inner surface of the drum shell at location 19. Location 19 extends parallel to axis 15. The pusher is pushed upwardly by an air cylinder structure 20, which exerts upward force on a support 21 carrying the pusher. A motor 22 rotates the pusher as by means of a belt 23 extending between pulleys 24 and 25, as seen in FIG. 2, pulley 25 connected to a rotary core 26 for the cylindrical pusher. These elements move up and down with the pusher and the motor may be suitably supported as by bar 30.

Two idler rollers 27 and 28 extend parallel to the pusher engaging the inner surface 13*b* of the drum shell at roller locations to provide three-point support for the shell, as it rotates. Those rollers are carried by support bar 30 vertically positioned by another air cylinder 32. The piston in cylinder 32 drives a line 33, an upward end of which is connected to the bar 30, and the lower end of which is also connected to the bar, so that the bar is driven vertically up or down, depending upon the direction of actuation of the piston for initial vertical adjustment of drum 13. Note vertical guides 37 and 38 for the bar.

First structure is provided on the frame, including sanding belt 14, for engaging the drum shell outer surface 13*a* during drum rotation, thereby to abrade or sand the drum surface as desired, no matter what the size of the drum as to length or diameter. The belt 14 extends in a loop having upper and lower stretches 14*a* and 14*b*. In the preferred embodiment, the lower stretch engages the drum surface as the belt travels endlessly in a loop. Note rollers 40 and 41 engaging opposite ends of the belt loop, as seen in FIG. 1, to support and position the loop. Those rollers are carried by the frame 10, as at bearings 42 and 43. The motor 44 drives the sanding belt, as via a drive belt 45, engaging sheaves 46 and 47 associated with the motor and the roller 40, respectively.

A hold-down yoke 48, carried by the frame at 49, presents idlers 50 and 51 downwardly to engage the belt stretch **14*b*** as shown, thereby to hold the belt in engagement with the drum shell outer surface being sanded.

The pusher 18 may be considered as a preferred form of second means on the frame, to effect pressural engagement of the rotating drum surface with the sanding belt. Such second means preferably also includes a primary actuator, as described at 20; and third means is provided to control operation of that actuator to control pusher positioning in a direction toward the sanding belt and toward the belt hold-down means 48. See for example the control unit 60 operatively connected with the actuators 20 and 32, and with the motors described herein, and which include belt motor 44.

Carrier means is provided on the frame for relatively moving the drum shell and sanding belt in a direction parallel to the drum axis. Such carrier means preferably carries the above-described second means, including actuator 20 and pusher 19. The carrier means includes a movable carrier 72, and as is shown, may include a support **72*a* for a guide roller 73*a* engaging a track 74*a*, and likewise, a support 72*b* for a guide roller 73*b* traveling lengthwise on a track 74*b*. The two tracks are parallel, as is shown, and extend in the direction of the drum axis 15**, whereby the movable carrier is movable axially as respects the drum axis, thereby to carry the drum transversely of the sanding belt and its direction of travel. This permits a narrow sanding belt to sand a drum shell surface of greater length than the belt width, whereby the same belt may be used to sand a series of drum shells of different lengths and of different diameters.

Control means is also provided to adjust the extent of travel of the carrier 72 along the track or tracks, thereby to adjust the position of the drum surface relative to the belt sanding that surface. In the example, the control means includes a motor 80 supported at 81 on the frame base 11. The motor is coupled to the carrier 72 by an adjustable linkage enabling adjustment of carrier travel.

In the example shown, that linkage includes a crank 82 rotatably driven by an output shaft 83 and a link 84 pivotally connected to the crank at Accordingly, as the motor rotates, crank 84 travels back and forth in the direction of the tracks to drive the carrier back and forth, i.e., in reciprocation. A speed-reducing drive associated with the motor provides output shaft 83.

The opposite end of the link 84 is pivotally connected at 85 to an upwardly angled arm 86, the lower end of which is in turn pivotally connected at 87 to the frame. As link 84 moves endwise back and forth, arm 86 is rotated back and forth. It has adjustment connection at 88 to the carrier, as via another bar 89. As bar 86 moves back and forth, bar 89 and the carrier are pushed back and forth by bar 86. A slot 93 in arm 86 accommodates relative movement of 86 and 89, and a slider 90 attached to the bar 89 slides in the slot. A handle 91 is connected to a member 92 that tightens the slider. As the handle is tightened, the relative motion of the bars 86 and 89 is fixed, to lock the carrier in a selected position on the tracks, allowing sanding at one location on the drum.

Figure 8:
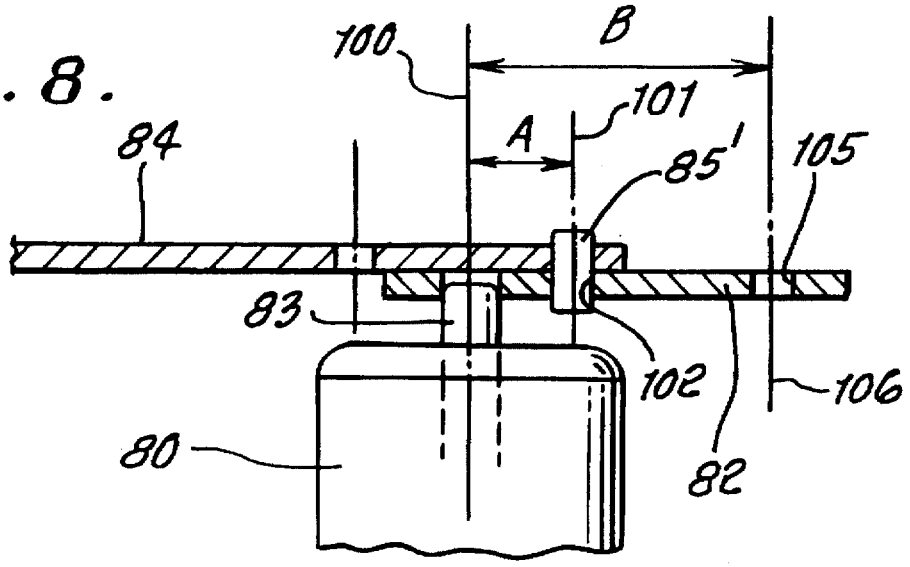
FIG. 8 is a section taken on lines 8—8 of FIG. 3.

FIG. 8 shows a means to lengthen the effective length of the crank 82. The "short", effective length, as shown, is indicated at A, i.e., the dimension between the drive output shaft axis 100 and the axis 101 of the pin 85 connector between 82 and 84. See opening 102 in 82. This is a short stroke movement for sanding of smaller drums, such as Tom Toms. For larger drums, such as bass drums, the stroke B is longer. This is achieved by locating pin 85 in crank opening 105 having axis 106.

Figure 7:
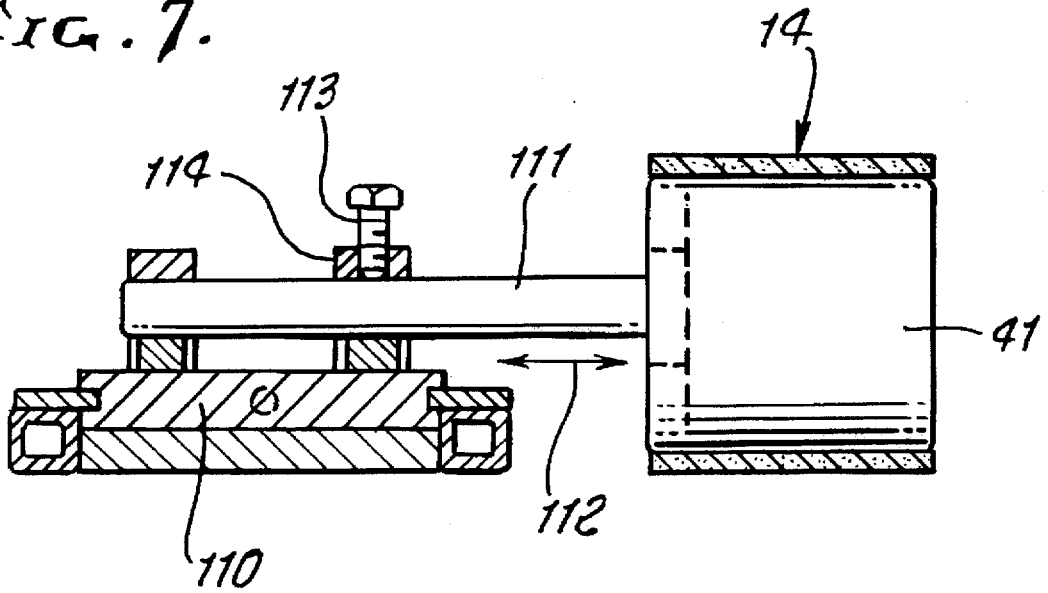
FIG. 7 is a section taken on lines 7—7 of FIG. 6.

FIG. 7 shows a sliding plate 110 carrying the idler hub roller 41 for the belt 14. A mounting shaft 111 for that roller is adjustable lengthwise in direction 112 to adjust the belt position. A clamp screw 113 adjustably clamps the shaft 111 to a block 114 on plate 110.

Figure 6:
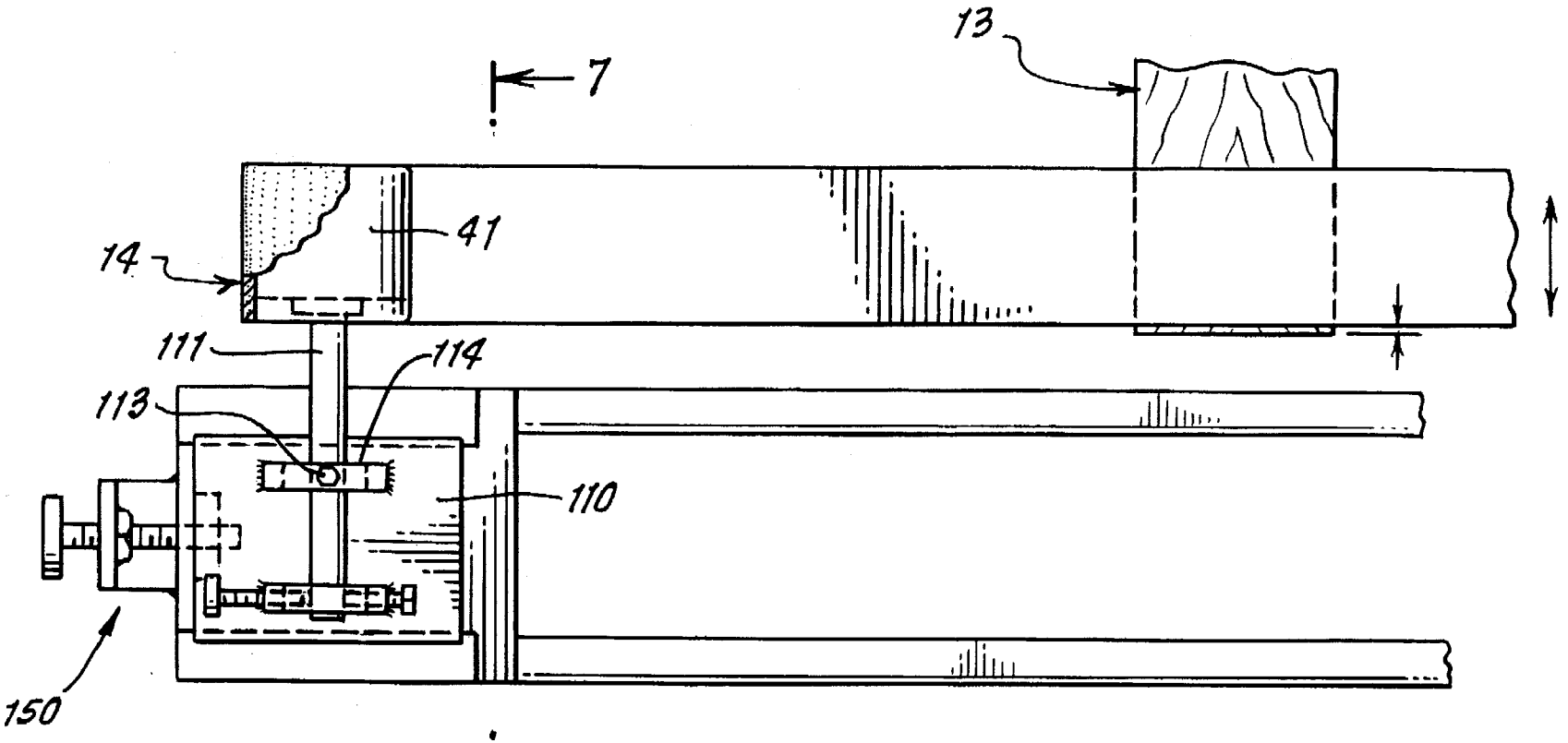
FIG. 6 is a top plan view taken on lines 6—6 on FIG. 1.

Tension adjusting means is provided at 150 (see FIG. 6) for belt 14, by adjusting the position of roller 41.

It will be understood that, although the belt has been referred to and described as a drum surface sanding belt, the belt can be a drum surface buffing belt. In general, the belt is a drum surface treating belt, for example for buffing, or for sanding, or for other surface treatment.

I claim:

1. In apparatus to process the outer surface of a cylindrical drum shell, said shell defining a first longitudinal axis, the combination comprising:

a) a frame, b) first means on the frame to position and rotate the drum about said axis, c) first structure on the frame, including a belt, for engaging the drum surface during drum rotation, d) and second means on the frame to effect pressural engagement of the rotating drum surface with the belt e) said belt being one of the following:

i) a drum surface sanding belt, ii) a drum surface buffing belt f) said second means including a pressure roller at the inside of said cylindrical drum shell.

2. The combination of claim 1 wherein said belt extends in a loop, and said first structure includes third means to drive the belt loopwise to tangentially travel in treating engagement with the rotating drum surface.

3. The combination of claim 2 wherein said belt has width substantially less than the maximum width of the drum shell to be treated.

4. In apparatus to sand the outer surface of a cylindrical drum shell, said shell defining a first longitudinal axis, the combination comprising:

a) frame, b) first means on the frame to position and rotate the drum about said axis, c) first structure on the frame, including a sanding belt, for engaging the drum surface during drum rotation, d) and second means on the frame to effect pressural engagement of the rotating drum surface with the sanding belt, e) and wherein said second means includes a primary actuator including a rotatable pusher engaging the drum, and third means to control operation of the actuator to control pusher positioning in a direction toward the sanding belt.

5. The combination of claim 4 wherein said rotatable pusher engages an inner cylindrical surface defined by the drum shell.

6. The combination of claim 5 wherein said second means also includes drum shell positioning idler means engaging the shell, and positioned by said third means.

7. In apparatus to sand the outer surface of a cylindrical drum shell, said shell defining a first longitudinal axis, the combination comprising:

a) a frame, b) first means on the frame to position and rotate the drum about said axis, c) first structure on the frame, including a sanding belt, for engaging the drum surface during drum rotation, d) and second means on the frame to effect pressural engagement of the rotating drum surface with the sanding belt, e) and including carrier means on the frame for relatively moving the drum shell and sanding belt in a direction parallel to the drum axis.

8. The combination of claim 7 wherein said carrier means carries said second means.

9. The combination of claim 8 wherein said carrier means includes a movable carrier carrying said second means, and a track supporting said movable carrier, said track extending in the direction of said axis.

10. The combination of claim 9 including a drive operatively connected to the carrier to adjustably drive the carrier along said track, thereby to transport the drum shell crosswise of the belt.

11. The combination of claim 10 including control means to adjust the extent of travel of the carrier along said track.

12. The combination of claim 11 wherein said control means includes an adjustable linkage coupling said drive to said frame.

13. The combination of claim 7 wherein said belt is an elongated sanding belt.

14. The combination of claim 7 wherein said belt is a drum surface buffing belt.

* * * * *